US010358246B2

(12) United States Patent
Zarur

(10) Patent No.: US 10,358,246 B2
(45) Date of Patent: Jul. 23, 2019

(54) METHOD OF OPERATING AN APPARATUS FOR APPLYING DRINKING STRAWS TO PACKAGING CONTAINERS AND AN APPARATUS OPERATED BY THE METHOD

(71) Applicant: Tetra Laval Holdings & Finance S.A., Pully (CH)

(72) Inventor: Ashraf Zarur, Lund (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 15/534,106

(22) PCT Filed: Nov. 27, 2015

(86) PCT No.: PCT/EP2015/077985

§ 371 (c)(1),
(2) Date: Jun. 8, 2017

(87) PCT Pub. No.: WO2016/091622

PCT Pub. Date: Jun. 16, 2016

(65) Prior Publication Data

US 2017/0334592 A1 Nov. 23, 2017

(30) Foreign Application Priority Data

Dec. 10, 2014 (SE) ..... 1451503

(51) Int. Cl.
*B65C 9/42* (2006.01)
*B65B 57/06* (2006.01)
(Continued)

(52) U.S. Cl.
CPC ..... *B65B 61/205* (2013.01); *B65B 57/04* (2013.01); *B65B 57/06* (2013.01); *B65B 57/08* (2013.01);
(Continued)

(58) Field of Classification Search
CPC ..... B65B 61/20; B65B 61/202; B65B 61/205; B65C 9/42
(Continued)

(56) References Cited

U.S. PATENT DOCUMENTS 4,372,797 A * 2/1983 Dilot ..... B65B 61/205 156/249
4,384,915 A * 5/1983 Utsumi ..... B29C 65/18 156/499
(Continued)

FOREIGN PATENT DOCUMENTS

CA 2377763 A1 * 12/2000 ..... B65C 9/1869
EP 1042172 5/1998
(Continued)

OTHER PUBLICATIONS

Office Action in corresponding Swedish Application No. 1451503-5 dated Jun. 30, 2015 (7 pages).
(Continued)

*Primary Examiner* — Stephen F. Gerrity
*Assistant Examiner* — Joshua G Kotis
(74) *Attorney, Agent, or Firm* — Finnegan, Henderson, Farabow, Garrett & Dunner LLP

(57) ABSTRACT

The invention relates to a method of operating an apparatus for applying drinking straws to packaging containers. The method comprises the steps of performing a motion cycle of a drive means for bringing at least one drinking straw into a picking position, and adapting said motion cycle such that, at the point when an application device picks the drinking straw at the picking position, the acceleration of the drive means is substantially zero and the velocity of the drive means is kept at a set point velocity. The invention also relates to an apparatus being operated according to the method.

12 Claims, 3 Drawing Sheets

(51) Int. Cl.

| | |
|---|---|
| ***B65B 57/08*** | (2006.01) |
| ***B65B 57/14*** | (2006.01) |
| ***B65B 61/20*** | (2006.01) |
| ***B65B 65/02*** | (2006.01) |
| ***B65B 57/04*** | (2006.01) |

(52) U.S. Cl.
CPC ..... *B65B 57/14* (2013.01); *B65B 65/02* (2013.01); *B65C 9/42* (2013.01)

(58) Field of Classification Search
USPC ..... 53/128.1, 133.1, 133.2, 133.3, 410, 412
See application file for complete search history.

(56) References Cited

U.S. PATENT DOCUMENTS 4,502,910 A * 3/1985 Voltmer ..... B31D 1/021 156/238
4,584,046 A * 4/1986 Geyssel ..... B65B 61/205 156/353
4,584,819 A * 4/1986 Hakansson ..... B65B 61/205 53/133.1
4,707,965 A * 11/1987 Becker ..... B65B 61/205 53/133.1
4,709,800 A * 12/1987 Olsen ..... B65G 47/29 198/459.1
4,934,510 A * 6/1990 Lutgendorf ..... B65G 15/14 198/398
5,067,304 A * 11/1991 Kuethe ..... B65B 57/14 53/133.1
5,197,586 A * 3/1993 Marti Sala ..... B65G 15/12 198/462.3
5,256,239 A * 10/1993 Voltmer ..... B65C 9/188 156/351
5,979,142 A * 11/1999 Kraft ..... B65B 61/205 53/133.1
6,282,865 B1 * 9/2001 Bergstrom ..... B65B 61/205 53/128.1
6,526,725 B1 * 3/2003 Williams ..... B65B 61/205 493/379
6,601,371 B1 * 8/2003 Fertig ..... B65B 41/18 53/389.2
7,946,098 B1 5/2011 Wild et al.
2002/0084014 A1 * 7/2002 Klein ..... B65C 9/1869 156/64
2002/0096260 A1 * 7/2002 Yang ..... B65C 3/14 156/351
2007/0082148 A1 * 4/2007 Wild ..... B65B 61/205 428/34.1
2010/0300040 A1 12/2010 Lindback et al.
2015/0274438 A1 * 10/2015 Carmichael ..... B65G 29/00 156/60

FOREIGN PATENT DOCUMENTS

| | | | |
|---|---|---|---|
| JP | 2000-302110 | 10/2000 | |
| JP | 2009298486 A * | 12/2009 | ..... B65B 61/205 |
| SE | 1451136-4 | 9/2014 | |
| WO | WO 98-51572 | 11/1998 | |
| WO | WO 2016/045921 | 3/2016 | |

OTHER PUBLICATIONS

International Search Report and Written Opinion from corresponding PCT Application No. PCT/EP2015/077985 (10 pages).

* cited by examiner

METHOD OF OPERATING AN APPARATUS FOR APPLYING DRINKING STRAWS TO PACKAGING CONTAINERS AND AN APPARATUS OPERATED BY THE METHOD

This is a National Phase of PCT Application No. PCT/EP2015/077985, filed Nov. 27, 2015, which claims the benefit of Swedish Application No. 1451503-5 filed Dec. 10, 2014, which is incorporated herein by reference.

TECHNICAL FIELD

The present invention relates to a method for operating an apparatus for applying drinking straws to packaging containers, and to an apparatus operated according to the method.

BACKGROUND ART

Many packaging containers for liquid food are manufactured in so-called portion volumes, intended to be consumed direct from the package. The majority of these packages are provided with drinking straws in a protective envelope which is secured to the one side wall of the packaging container. The packaging containers, which are often parallelepipedic in shape, are manufactured from a laminate with a core of paper or paperboard, with layers of thermoplastics and possibly aluminum foil. On the one wall of the packaging container—most often the top wall—a hole has been punched out in the core layer and this hole is covered by the other layers of the laminate, which makes it possible to penetrate the hole with the drinking straw which accompanies the packaging container, and hereby consume the drink enclosed in the package.

There have long been machines which apply drinking straws in their protective envelopes to packaging containers which are conveyed through the machine. Such a machine, i.e. a drinking straw applicator, is, for example, described in the European Patent Specification EP-1 042 172. The applicator functions in that a belt of continuous drinking straw envelopes with drinking straws is guided in towards and surrounds a drive means. Adjacent the drive means, there are devices for severing the drinking straw belt into individual drinking straws enclosed in a protective envelope, as well as devices for applying the drinking straw to one side wall of the packaging container, the packaging container being advanced on a conveyor through the machine. Prior to the moment of application, the envelope drinking straw is provided with securement points. The securement points may, for example, consist of hot melt, which is molten glue which glues the drinking straw envelope in place and retains it when the glue has hardened. In this applicator the drive means rotates continuously and the device for separating drinking straws is disposed to accompany a part distance of the rotation of the drive means. Also the conveyor is driven continuously, and the device for applying drinking straws is disposed to accompany a part distance of the movement of the conveyor belt.

In ultra high speed production, handling approximately 40 000-50 000 packages/hour, the motions of the components of a straw applicator, in particular motions including considerable accelerations and decelerations, will give rise to substantial strain on the one or more motors involved and considerable vibrations will be created in the mechanics of the machine.

The Swedish patent application No. 1451136-4 describes an ultra high speed straw applicator. This straw applicator is operated to keep an even pitch between packages, and can thereby for example reduce vibrations. However, there are further improvements to be made for even smoother operation.

OBJECT OF THE INVENTION

One object of the present invention is to realise a method for operating a machine for applying drinking straws to packaging containers, which method minimizes vibrations and provides a smooth operation also in ultra high speed production. According to a first aspect of the invention, the object is solved by a method of operating an apparatus for applying drinking straws to packaging containers. Said apparatus comprises a drive means adapted for conveying drinking straws wrapped in protective envelopes to a picking position, an application device adapted to pick a drinking straw with envelope from the drive means at the picking position and apply said drinking straw to a wall of the packaging container, a first conveyor adapted for conveying packaging containers past the apparatus. The method comprises the steps of performing a motion cycle of the drive means for bringing at least one drinking straw into the picking position, and adapting said motion cycle such that, at the point when the application device picks the at least one drinking straw at the picking position, the acceleration of the drive means is substantially zero and the velocity of the drive means is substantially equal to a set point velocity.

In one or more embodiments the method comprises the steps of detecting the pitch between successive packaging containers, and adapting each motion cycle of the drive means to fit the corresponding pitch, still keeping substantially zero acceleration and set point velocity of the drive means at the point when the application device picks the drinking straws.

In one or more embodiments the method comprises the steps of performing one motion cycle of the drive means comprises the step of rotating the drive means one division, one division being the circumferential distance between two successive drinking straws.

In one or more embodiments the step of adapting each motion cycle of the drive means, to fit the corresponding pitch, comprises the step of adapting the time period of the motion cycle such that it becomes equal to a time period needed for conveying a packaging container the pitch, the pitch being the distance between two successive packaging containers being conveyed on the first conveyor.

In one or more embodiments, if detecting a pitch between two successive packaging containers which is shorter than a set point pitch value, the motion cycle of the drive means will be adapted by smoothly accelerating to a velocity higher than the set point velocity and then smoothly decelerating back to the set point velocity, still keeping zero acceleration at the point when a drinking straw is picked at the picking position.

In one or more embodiments, if detecting a pitch between two successive packaging containers which is longer than a set point pitch value, the motion cycle of the drive means will be adapted by smoothly decelerating to a velocity lower than the set point velocity and then smoothly accelerating back to the set point velocity, still keeping zero acceleration at the point when a drinking straw is picked at the picking position.

In one or more embodiment the adaption of the motion cycle is made by a control device, which control device is connected to a drive unit driving the drive means and the application device.

In one or more embodiments the method comprises the step of, during operation of the apparatus, driving the drive unit with a minimum of acceleration variations.

In one or more embodiments the method comprises the step of adjusting the pitch, between the packaging containers being transported on the first conveyor to the application device, by means of a pitch control device upstream the application device, such that the pitch becomes substantially equal between successive packaging containers and equal for all packaging sizes with an operational range of packaging sizes.

In one or more embodiments the method comprises the step of keeping a substantially constant velocity of the first conveyor during operation of the apparatus.

According to a second aspect of the invention, the object is solved by an apparatus for applying drinking straws to packaging containers. The apparatus comprises a drive means adapted for conveying drinking straws wrapped in protective envelopes to a picking position, an application device adapted to pick a drinking straw with envelope from the drive means at the picking position and apply said drinking straw to a wall of the packaging container, a first conveyor adapted for conveying packaging containers past the apparatus, a control device for controlling the operation of the apparatus, which control device is connected to a drive unit driving the drive means and the application device. The apparatus is adapted to be operated according to the method described above.

BRIEF DESCRIPTION OF THE ACCOMPANYING DRAWING

One preferred embodiment of the present invention will now be described in greater detail hereinbelow, with reference to the accompanying drawing, in which.

The drawings show only those details essential to an understanding of the present invention, and the remaining parts of the apparatus, which are well-known to a person skilled in the art, have been omitted.

DESCRIPTION OF PREFERRED EMBODIMENT

Figure 1:
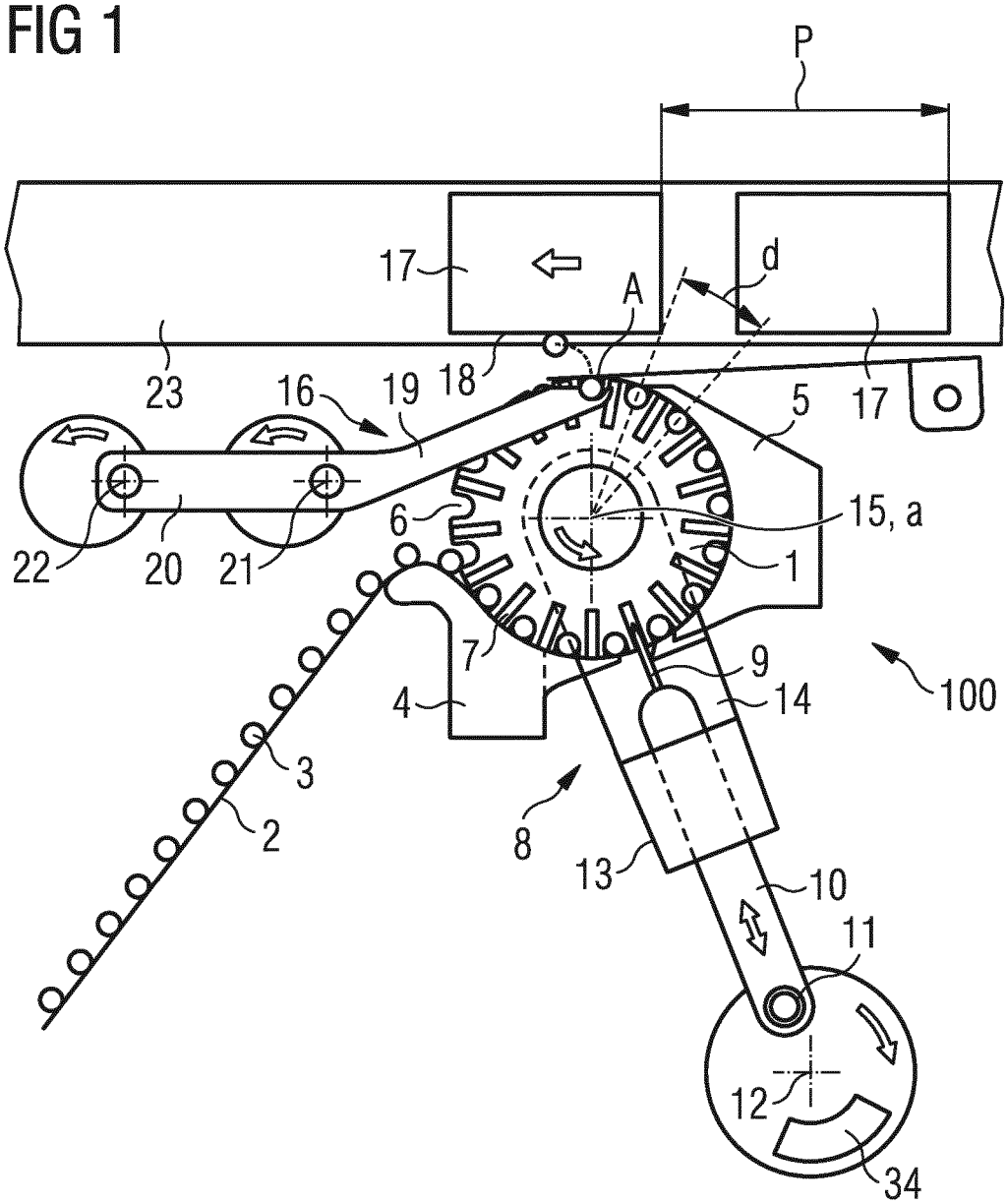
FIG. 1 is a schematic illustration, in plan view.

FIG. 1 shows some of the central parts of the apparatus 100. The apparatus comprises a drive means 1, a so-called feed wheel. A continuous belt 2 of drinking straws 3, wrapped in protective envelopes, is advanced to the drive means 1. The belt 2 of drinking straws 3 is advanced via guides (not shown) as well as guides 4 and 5 surrounding the drive means 1 and which retain the belt 2 of drinking straws 3 against the drive means 1. The drive means is adapted to rotate by means of a first motor (not shown), e.g. a servo motor, of a drive unit. The servo motor is preferably arranged displaced from the drive means 1, and is connected to a centre shaft 15 of the drive means 1 via a belt and/or cogwheels/gears (not shown).

On its circumferential surface, the drive means 1 has a number of recesses 6 which are each intended for one drinking straw 3. The number of recesses 6 on the drive means 1 depends on the thickness and design of the drinking straw 3, and the pitch between straws in the belt. In a conventional belt of straight and telescopic straws the pitch is e.g. 15 mm, whereas for U-shaped straws the pitch is e.g. 22 mm.

Between each recess 6 on the circumferential surface of the drive means 1, there is disposed a groove 7. The groove 7 is intended to receive a knife 9 of a separation device 8 for separating individual drinking straws 3, and their envelopes, from the belt 2.

The separation device 8, for separating the drinking straws 3, comprises the knife 9, which knife 9 is fixedly mounted in a holder 10. The holder 10 is journalled on an eccentric shaft 11. A centre shaft of a disc 12, to which the eccentric shaft 11 is fixed, is driven by the first servo motor via the same belt and/or cogwheels/gears driving the drive means 1. Hence, the separation device 8 and the drive means 1 are mechanically interconnected and both the rotation of the drive means 1 and the motion of the separation device 8 are driven by the first servo motor. Further, the knife holder 10 is journalled in an axial bearing 13, which bearing is fixedly attached to a rod 14 rotatably journalled around the centre shaft 15 of the drive means 1.

The apparatus 100 further includes an application device 16 for applying a drinking straw 3 on one side wall 18 of a packaging container 17. The application device 16 comprises two applicator arms 19. With two cooperating applicator arms 19, a more reliable and efficient placing of the drinking straws 3 on the side wall 18 of the packaging containers 17 will be obtained.

The arms 19 are oriented above one another and are united by means of a bracket 20, which may in principle consist of an extension of the applicator arms 19. The bracket 20 is journalled in two eccentric shafts 21, 22 which have the same eccentricity. The drive means 1 is provided with parallel grooves (not shown) along its circumference. The applicator arms 19 are arranged to move in these grooves, and at at least one point be arranged in between the drive means and a separated straw 3, to be able to pick the straw 3 and carry it towards the side wall 18 of a packaging container 17. The application device 16 is driven by a second motor (not shown), e.g. a servo motor, of the drive unit. The second servo motor drives the application device 8 via a belt and/or cogwheels/gears.

The apparatus 100 further comprises a first, lower conveyor 23, passing by the drive means 1, for conveying the packaging containers 17 which are to be supplied with drinking straws 3. The conveyor 23 may consist of an endless, driven belt. Only a portion of the conveyor is shown in FIG. 1.

Figure 2:
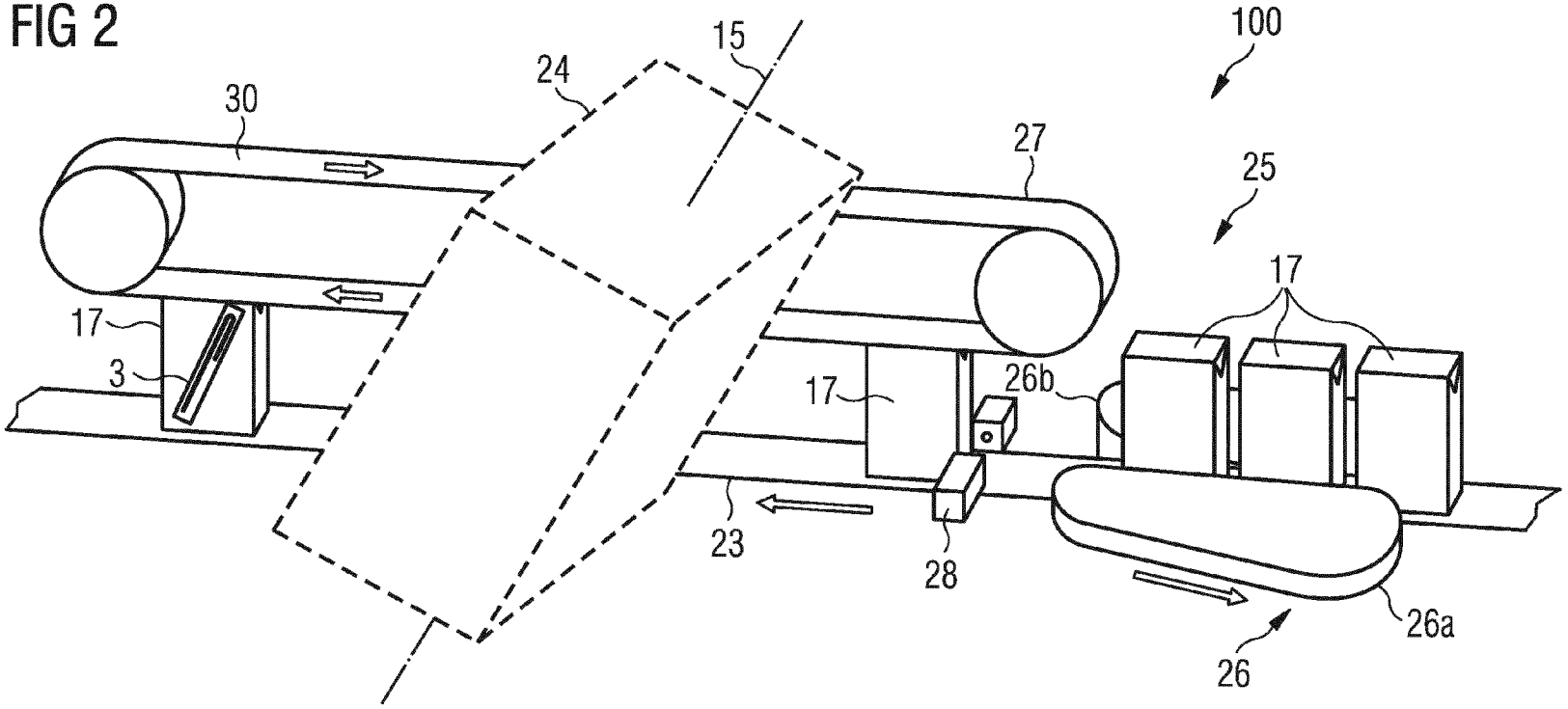
FIG. 2 is a schematic illustration in perspective view of the apparatus according to the present invention.

The drive means 1, the application device 16 and the separation device 8 are designed such that it may be variably inclined in relation to the conveyor 23. In this way the packaging containers 17, which are advanced with their bottom surface bearing on the horizontal conveyor 23, will have the drinking straws 3 placed in the desired angle of inclination on the side wall 18. The inclination depends on both the volume of the packaging container 17 and on the size and shape of the drinking straw 3. FIG. 2, showing the entire apparatus 100, illustrates the inclination. For simplification the drive means 1, the separation device 8 and the application device 16 are shown as a box 24 drawn with dashed lines. An axis illustrating the inclination of the centre shaft 15 of the drive means 1 is shown, and a packaging container is also shown having a straw applied with a similar inclination.

The drive means 1, which is disposed to rotate continuously during operation, is the central unit in the apparatus 100, see FIG. 1 again. It is the drive means 1 which transports the drinking straws 3 round from when the continuous belt 2 of drinking straws 3 wrapped in protective envelopes reaches the apparatus 100 via a number of guides (not shown), around the circumferential surface of the drive means 1, past the separation device 8 to the application device 16. The drive means 1 moves with a gear ratio from the first servo motor which depends on the number of recesses 6 on the circumferential surface of the drive means 1. The drive means 1 rotates one division, i.e. one recess 6 for each packaging container 17 which passes the drive means 1. For example, a drive means 1 for straight drinking straws 3 may have a gear ratio of 17:1 and a drive means 1 for U-shaped drinking straws may have a gear ratio of 12:1.

The separation device 8, for separating a straw 3, in its envelope, from the rest of the belt 2 executes two movements during each separation cycle. On the one hand, the knife 9 reciprocates radially in relation to the drive means 1 and into the groove 7 in order to be able to separate one drinking straw 3 from the belt 2. On the other hand, the separation device 8 must accompany the continuously rotating drive means 1 during that time when the separation cycle is in progress. These two movements are simultaneously achieved by means of the eccentricity of the shaft 11 and the alternating, pivoting motion (counterclockwise and clockwise) of the rod 14 around the shaft 15 of the drive means 1.

Once the separation cycle is completed and the knife 9 has severed one drinking straw 3, in its protective envelope, from the continuous belt 2, the separation device 8 returns to its starting position and begins a new separation cycle.

The first conveyor 23 moves tangentially in relation to the drive means 1 and conveys the packaging containers 17, which are to be provided with drinking straws 3, past the drive means 1. The first conveyor 23 moves at a speed which is synchronised with the speed of the drive means 1, the separation device 8 and the application device 16. Before the separated straws 3 are picked by the application device 16, their envelopes have been provided, on one of their side surfaces, with securement points, preferably two in number, which may, for example, consist of glue, preferably so called hot melt. The securement points are to glue in place and, once the hot melt glue has set, retain the drinking straw 3 in its protective envelope against the side wall 18 of the packaging container 17.

The application device 16 for applying drinking straws 3 on the side walls 18 of the packaging containers 17 describes, by means of the two eccentric shafts 21, 22, a circular or alternatively elliptic movement so that the arms 19 move in towards the drive means 1 and entrap a drinking straw 3. The drinking straw 3 is moved by the rotating movement towards the side wall 18 of the packaging container 17 and is kept in position by means of the securement points. As a result of the second servo motor and requisite gear ratios, the applicator arms 19 now move at the same speed at which the conveyor 23 (and thereby also the packaging container 17) moves, and the applicator arms 19 accompany, in their rotating movement, the packaging container 17 and the conveyor 23 a short distance before the rotational movement recuperates the applicator arms 19 back to their starting position where they begin a new application cycle.

By means of FIG. 2 more parts of the apparatus 100 will be described. The apparatus 100 comprises a packaging container sensing device 28 for sensing a packaging container 17 passing on the first, lower conveyor 23. The sensing device 28 comprises any conventional type of sensor, e.g. a photocell arrangement, able to detect a passing packaging container. The sensing device 28 is arranged upstream the drive means 1. The photocell arrangement is in two parts, said parts being aligned and facing each other in a direction perpendicular to the transport direction of the lower conveyor 23. The two parts are shown in FIG. 2.

The sensing device 28 is positioned at a fixed distance from the position where the application device 16 applies the straw 3 onto the packaging container 17. Passage of a packaging container sends a signal to a control device (not shown) of the apparatus, e.g. a PLC, which will time the movements of the drive means 1, separation device 8 and the application device 16 based on the detection of the packaging container being transported on the lower conveyor 23. The timing is made by accelerating or decelerating the first and second servo motors of the drive unit and in that way the straw will be applied at a correct position on the packaging container once the packaging container reaches the application device 16. Hence, with regard to the sensing device 28 and the control device any distance between the packaging containers can be dealt with, e.g. if the distance between succeeding packaging containers is not exactly equal, or even highly differs between two succeeding packaging containers, it will still work since the application cycle is individually timed for each passing packaging container by acceleration or deceleration of the first and second servo motors.

Figure 3:
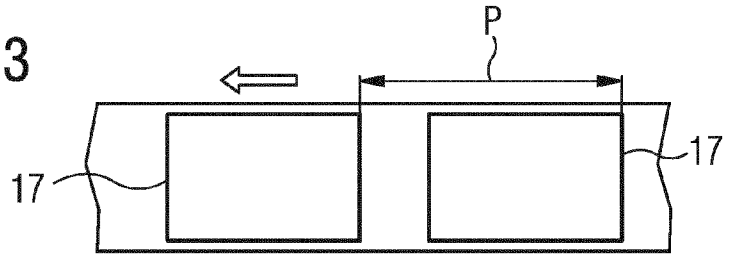
FIG. 3 is a schematic illustration, in top view, of two packaging containers and a conveyor.

In FIG. 2 the drive means 1, the application device 16, the separation device 8 and the associated servo motors etc. are shown, for simplification, as a box 24 in dashed lines. FIG. 2 further shows the previously described first conveyor 23 and the sensing device 28 being parts of the apparatus of the present invention. The apparatus 100 further comprises a pitch control device 25 for controlling the pitch, i.e. the distance, between succeeding packaging containers 17 being fed to the drive means 1. The definition of pitch is illustrated by means of FIG. 3. The pitch, denoted P, is the distance between similar points on two succeeding packaging containers 17. In the figure the pitch P is measured from a back surface of a leading packaging container to the back surface of a trailing, or successive, packaging container.

The pitch control device 25 is arranged upstream the drive means 1 and comprises a packaging container decceleration device 26, e.g. a belt brake, and a second, upper conveyor 27.

The decceleration device 26, being a belt brake in this embodiment, is arranged upstream the sensing device 28 and the second upper conveyor 27. The belt brake has belts 26*a*, 26*b* on each side of the lower conveyor 23. The belts 26*a*, 26*b* are partly running in parallel with the transported packaging containers 17 in such a way that said belts are adapted to come into contact with two opposed side walls of each packaging container, and decelerate and transport the packaging container at a velocity being less than that of the conveyor 23. Hence, the belts 26*a*, 26*b* are adapted to create higher friction against the packaging container 17 than the friction between the packaging container 17 and the lower conveyor 23. The packaging container will thus slide against the lower container 23 and queue up, or line up, in the belt brake 26.

The second, upper conveyor 27 is arranged above a portion of the first, lower conveyor 23, and is adapted to help transporting the packaging containers by supporting their top surface. The upper conveyor also keeps track of the position of the packaging container in relation to the application device, in that a third motor (not shown), for example a servo motor, used for driving the conveyor, is used, based on the servo motor speed, to calculate the time before the packaging container passes the application device. The upper conveyor 27 comprises a belt 30 adapted to bear against the top surface of the packaging container. The upper conveyor 27 is positioned such that it will come into contact with a packaging container while the packaging container is about to leave the belt brake 26. This position, where the upper conveyor 27 contacts the packaging container 17, is upstream the sensing device 28. The distance between the packaging container transport surface of the lower conveyor 23 and the lower end of the belt 30 of the upper conveyor 27 equals the packaging container height, and can be adjusted to fit different packaging container sizes. Preferably, for this reason, the upper conveyor 27 is displaceable in relation to the lower conveyor 23.

The pitch control device 25 operates as follows. The velocities of the first, lower conveyor 23 and the second, upper conveyor 27 are set substantially equal. The velocity of the belts 26*a*, 26*b* of the belt brake 26 is set to be slower. Hence, as mentioned above, the packaging containers 17 will queue up once reaching the belt brake 26. Upon advancement of the packaging containers 17 through the belt brake 26, the packaging containers 17 will reach the downstream end of the belt brake 26. Just before leaving the belt brake 26 the packaging container will reach the upstream end of the upper conveyor 27. The upper and lower conveyors 23, 27 will then "pick" the packaging container 17 at the downstream end of the belt brake 26, and change its velocity to that of the upper and lower conveyors 23, 27. Due to the lower velocity of the belt brake 26, compared to that of the upper and lower conveyors 23, 27, the "picking" action will create a distance, pitch P (FIG. 3), between succeeding packaging containers 17. The packaging container 17 will proceed to the sensing device 28 which is positioned at a fixed distance from the position where the application device 16 applies the straw 3 onto the packaging container 17. The control device will time the movement of the drive means 1, separation device 8 and the application device 16 based on the detection of a packaging container, such that the straw 3 will be applied at a correct position on the packaging container once the packaging container reaches the application device 16. This is to adjust to variations in the pitch which may naturally still exist.

A pitch set point value $P_s$ is set (not shown). This is the ideal pitch for the capacity, in terms of velocity and acceleration, that the apparatus is designed for. The pitch set point value $P_s$ will be the same irrespective of the size of the packaging container, for sizes within an operational range of the apparatus. This means that the pitch will be the same for all packaging containers to be processed through the apparatus. With a fixed, pre-set pitch vibrations in the apparatus can be considerably minimised since the mechanics can be dimensioned and balanced for said pitch. This is further described in the Swedish patent application No. 1451136-4.

The drive unit is driven at a substantially constant speed, i.e. with a minimum of acceleration variations, as much as possible minimizing frequent, considerable accelerations and decelerations of the servo motors of the drive unit. The speeds of the servo motors are set by the apparatus' control device, which also controls the synchronization of the movements of the drive means 1, the separation device 8 and the application device 16, as well as of the conveyors transporting the packaging containers. If the pitch is set to 80 mm the drive unit will not go down into stop/standby mode (standstill of drive unit) if there is a packaging container coming within a pitch of 130 mm. It will decelerate some.

So far the general function of the apparatus 100 has been described. In the following the particular motion of the drive means 1 will be described in further detail.

The drive means 1, or feed wheel, is performing a motion cycle for bringing at least one drinking straw 3 into a picking position. The picking position is indicated by the letter A in FIG. 1.

As has been described above the drive means 1 in this embodiment is cylindrical and the drinking straws 3 in their envelopes are kept on the outer circumferential surface. The straw extension is parallel to the axial axis a of the cylindrical drive means 1. Hence, in order to advance a drinking straw 3 the drive means 1 is rotating one division around the axis a. One division is the rotation corresponding to the circumferential distance d between two successive drinking straws kept on the drive means 1. The motion cycle corresponds to the movement needed for rotating one division.

In this embodiment one drinking straw 3 is advanced per division and is made available at the picking position A where the application device 16, and i.e. the applicator arm 19, can pick it. The time available for rotating one division depends on the pitch P between the packaging containers. Since the speed of the first conveyor 23 is kept constant, the time period for bringing another packaging container in position for straw application will depend on the pitch. As mentioned above the pitch between successive packaging containers is detected by the sensing device 28, and the motion of the drive means 1 is adapted to fit the corresponding pitch.

Figure 4:
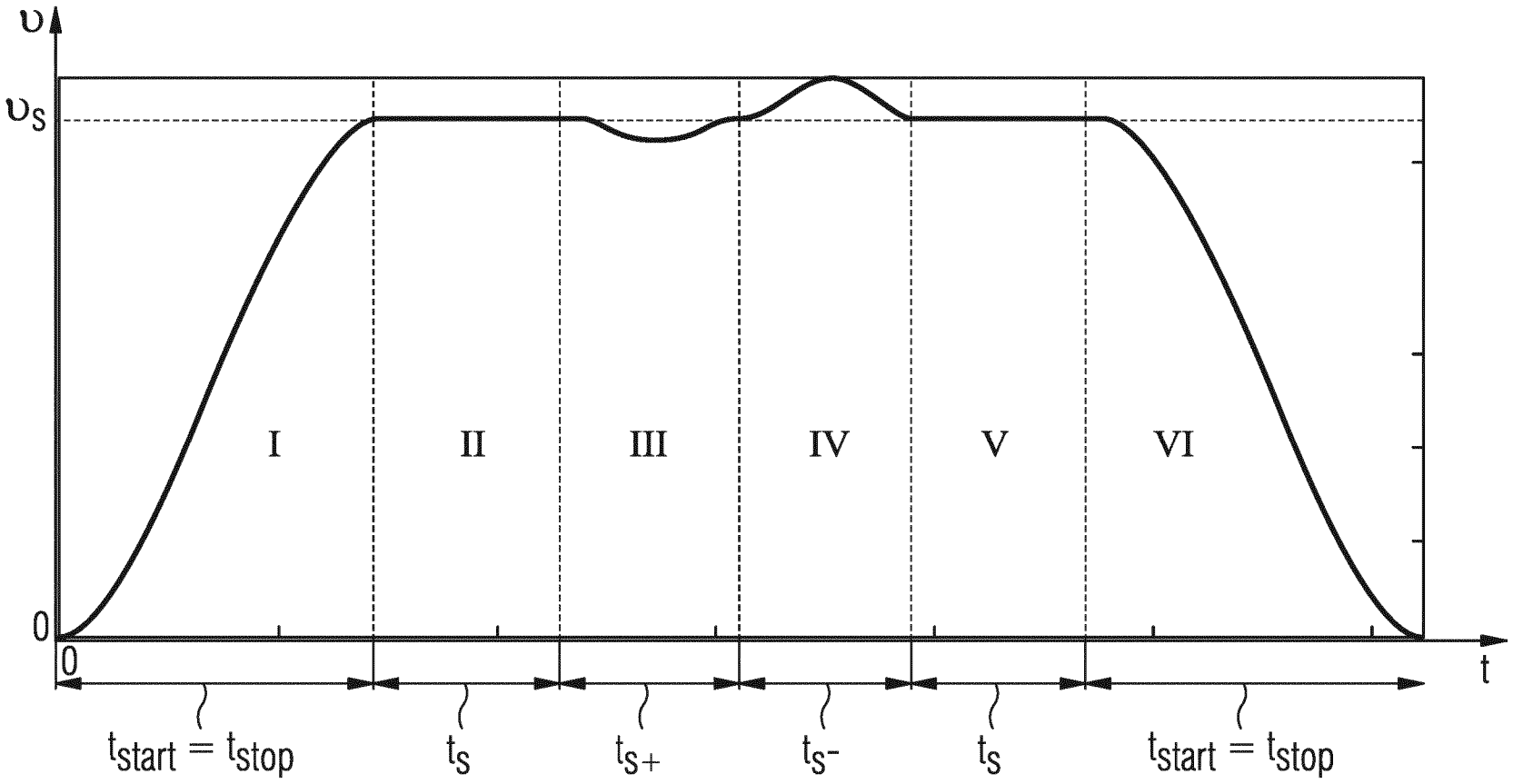
FIG. 4 is a graph showing a number of motion cycles of the drive means.

To provide for a smooth and faultless picking action of the drinking straw 3 as well as a smooth operation of the apparatus 100, the motion cycle is adapted such that at the point when the application device 16 picks the drinking straw 3 (i.e. at the picking position A), the acceleration of the drive means 1 is substantially zero and the velocity of the drive means 1 is kept at a set point velocity $v_s$ (illustrated in FIG. 4). The set point velocity $v_s$ is a velocity corresponding to one motion cycle for the fixed pitch, i.e. it corresponds to the set point pitch value $P_s$ and a set point time $t_s$, i.e. the set point velocity $v_s$ is the distance $d/P_s*v$, where v is the velocity of the first conveyor 23.

A motion cycle begins when the application device 16 has just picked a drinking straw 3 at the picking position. The velocity of the drive means 1 is the set point velocity $v_s$ and the acceleration is zero. The drive means 1 continues to rotate in order to advance a successive drinking straw 3 to the picking position. The motion cycle ends when the drinking straw 3 arrives to the picking position and is being picked by the applicator arms 19. At this point the velocity of the drive means 1 should again be equal to the set point velocity $v_s$ and the acceleration should be zero.

In an ideal case the pitch P to the successive packaging container 17 is equal to the set point pitch value $P_s$, and the set point velocity $v_s$ and the zero acceleration can be kept throughout the entire motion cycle. However, even though the apparatus 100 is designed to provide an even pitch P, there will still be slight variations in the pitch between the packaging containers 17. The ideal case is shown in FIG. 4, in sections II and V. FIG. 4 illustrates an exemplary and short operation period of the apparatus 100. The y axis of the graph shows the velocity of the drive means 1 and the x axis of the graph shows the time t of a motion cycle (which is dependent on the pitch P). The dashed vertical lines represent the point in time when a drinking straw is in the picking position, i.e. the transition from one motion cycle to a successive motion cycle.

In the event that the pitch P to the successive packaging container 17 is longer than the set point pitch value $P_s$, the drive means 1 needs to slow down not to provide the drinking straw 3 too early at the picking position, i.e. the time period for the motion cycle is increased from the set point time $t_s$ to a longer time $t_+$. This is illustrated in section III of FIG. 4. The motion cycle of the drive means 1 will be adapted by smoothly decelerating to a velocity lower than the set point velocity $v_s$ and then smoothly accelerating back to the set point velocity $v_s$. At the end of the motion cycle, when the drive means 1 has advanced the drinking straw to the picking position and the applicator arms 19 will pick it, the acceleration will be zero again and the velocity will again be equal to the set point velocity $v_s$.

In the event that a pitch P to the successive packaging container 17 is detected which is shorter than the set point pitch value $P_s$, the motion cycle of the drive means 1 needs to be performed in a time period t. which is shorter than the set point time $t_s$. This is illustrated in section IV of FIG. 4. The motion cycle is then adapted by smoothly accelerating to a velocity higher than the set point velocity $v_s$ and then smoothly decelerating back to the set point velocity $v_s$, still keeping zero acceleration at the point when the drinking straw is picked at the picking position.

Any change in acceleration will be made as smooth as possible, as sudden acceleration changes will cause unnecessary vibrations to the apparatus 100 and strains in the servo motors of the drive unit.

The adaption of the motion cycle is calculated by the control device, and the control device controls the drive unit of the drive means (and also further components needing adjustment).

Sections I and VI of FIG. 4 illustrate the respective start and end of a production cycle. Upon start-up of the apparatus 100, section I, the drive means 1 needs to rotate one division to provide a drinking straw at the picking position for the first packaging container arriving on the conveyor. A packaging container is detected by the sensing device 28 and during a time frame $t_{start,\ stop}$ the drive means 1 accelerates from zero to the set point velocity $v_s$ such that a drinking straw will arrive on time to the picking position. The applicator arms 19 pick the drinking straw. During this first motion cycle the control device awaits input from the sensing device 28 whether or not a successive packaging container is present on the first conveyor. As soon as such successive packaging container is detected the successive motion cycle can be calculated based on the pitch to the successive packaging container. If the pitch exceeds a certain maximum pitch, in this exemplary case 130 mm, the drive means decelerates back to zero velocity. This is also what will happen after the last packaging container in a production cycle. The deceleration is shown in section VI of FIG. 4. The transitions from section I to section II, and the transition from section V to section VI are made as smooth as possible.

The present invention should not be considered as restricted to the embodiment described above and shown in the drawings. It is apparent for a person skilled in the art that many modifications are being conceivable without departing from the scope of the appended claims.

For example, an apparatus according to the present invention may instead be employed for applying other objects such as, for example, spoons or the like which are intended to accompany the package 17 to the consumer.

The invention claimed is:

1. A method of applying drinking straws to packaging containers, by use of an apparatus including a drive mechanism configured to convey drinking straws wrapped in corresponding envelopes to a picking position, an application device adapted to pick at least one drinking straw in the corresponding envelope from the drive mechanism at the picking position and apply the at least one drinking straw to a wall of at least one packaging container, a first conveyor adapted for conveying packaging containers past the drive mechanism and the application device in a first direction at a first velocity, and a pitch control device located upstream of the application device for controlling a pitch between successive packaging containers conveyed by the first conveyor, the method comprising:

decelerating, by the pitch control device, the packaging containers relative to the first velocity at which the packaging containers are conveyed by the first conveyor by applying a decelerating force to the packaging containers along the first direction, such that, as the packaging containers advance through the pitch control device at a second velocity lower than the first velocity, the decelerating is configured to set the pitch between at least two successive packaging containers;

performing a motion cycle of the drive mechanism for bringing the at least one drinking straw into the picking position;

setting the motion cycle such that, when the application device picks the at least one drinking straw at the picking position, the acceleration of the drive mechanism is substantially zero and the velocity of the drive mechanism is substantially equal to a set velocity based on the set pitch;

detecting, after the packaging containers advance through the pitch control device, a variation in the set pitch between successive packaging containers; and adapting the set motion cycle of the drive mechanism based on the detected pitch variation, wherein adapting comprises accelerating or decelerating the velocity of the drive mechanism from the set velocity and such that when the application device picks the at least one drinking straw, the acceleration of the drive mechanism is substantially zero and the velocity of the drive mechanism is substantially equal to the set velocity.

2. The method according to claim 1, wherein performing the motion cycle of the drive mechanism comprises rotating the drive mechanism one division, wherein one division corresponds to a circumferential distance between two successive drinking straws.

3. The method according to claim 1, wherein adapting the set motion cycle of the drive mechanism based on the detected pitch variation comprises adapting a time period of the motion cycle such that it becomes equal to a time period needed for conveying a packaging container, wherein the pitch is the distance between two successive packaging containers being conveyed on the first conveyor.

4. The method according to claim 1, wherein, if the detected pitch variation indicates that a pitch between two successive packaging containers is shorter than the set pitch, then adapting the set motion cycle of the drive mechanism to accelerate to a velocity higher than the set velocity and decelerate back to the set velocity, such that the acceleration of the drive mechanism is substantially zero when the drinking straw is picked at the picking position.

5. The method according to claim 1, wherein, if the detected pitch variation indicates a pitch between two successive packaging containers is longer than the set pitch, then adapting the set motion cycle of the drive mechanism to decelerate to a velocity lower than the set velocity and accelerate back to the set velocity, such that the acceleration of the drive mechanism is substantially zero when the drinking straw is picked at the picking position.

6. The method according to claim 1, wherein adapting the set motion cycle comprises adapting the set motion cycle by a control device connected to a first motor driving the drive mechanism and a second motor driving the application device.

7. The method according to claim 6, further including:

driving at least one of the first motor and the second motor at a substantially constant speed.

8. The method according to claim 1, the method further comprising:

controlling the pitch, by the pitch control device, such that a distance between successive packaging containers conveyed on the first conveyor becomes substantially equal.

9. The method according to claim 1, wherein the first velocity of the first conveyor is substantially constant during operation.

10. The method according to claim 1, wherein decelerating, by the pitch control device, the packaging containers relative to the first conveyor further comprises bringing first and second belts of the pitch control device in contact with two opposing side walls of each packaging container.

11. The method according to claim 10, wherein a velocity of the first and second belts is lower than a velocity of the first conveyor.

12. An apparatus for applying drinking straws to packaging containers, comprising:

a drive mechanism configured to convey drinking straws wrapped in corresponding envelopes to a picking position, an application device adapted to pick at least one drinking straw in the corresponding envelope from the drive mechanism at the picking position and apply the at least one drinking straw to a wall of at least one packaging container, a first conveyor configured to convey packaging containers past the drive mechanism and the application device in a first direction at a first velocity, a pitch control device located upstream of the application device for controlling a pitch between successive packaging containers conveyed by the first conveyor, wherein the pitch control device is configured to decelerate the packaging containers relative to the first velocity at which the packaging containers are conveyed by the first conveyor by applying a decelerating force to the packaging containers along the first direction, such that, as the packaging containers advance through the pitch control device at a second velocity lower than the first velocity, the decelerating is configured to set the pitch between at least two successive packaging containers, and a control device for controlling the operation of the drive mechanism and the application device, wherein the control device is connected to a first motor driving the drive mechanism and a second motor driving the application device, and wherein the control device is configured to:

perform a motion cycle of the drive mechanism to bring the at least one drinking straw into the picking position;

set the motion cycle such that, when the application device picks the at least one drinking straw at the picking position, the acceleration of the drive mechanism is substantially zero and the velocity of the drive mechanism is substantially equal to a set velocity which is based on the set pitch;

detect, after the packaging containers advance through the pitch control device, a variation in the set pitch between successive packaging containers; and adapt the set motion cycle of the drive mechanism based on the detected pitch variation by accelerating or decelerating the velocity of the drive mechanism from the set velocity and such that when the application device picks the at least one drinking straw, the acceleration of the drive mechanism is substantially zero and the velocity of the drive mechanism is substantially equal to the set velocity.

* * * * *